US006679331B2

(12) United States Patent
Cordy et al.

(10) Patent No.: US 6,679,331 B2
(45) Date of Patent: Jan. 20, 2004

(54) COMPLIANT BUOYANCY CAN GUIDE

(75) Inventors: Alan R. Cordy, Houston, TX (US); James V. Maher, Houston, TX (US); Richard L. Davies, Houston, TX (US); W. Wade Mallard, Houston, TX (US); John Montague, Houston, TX (US); Pierre Beynett, Houston, TX (US)

(73) Assignee: CSO Aker Maritime, Inc., Houston, TX (US)

( * ) Notice: Subject to any disclaimer, the term of this patent is extended or adjusted under 35 U.S.C. 154(b) by 32 days.

(21) Appl. No.: 09/850,599

(22) Filed: May 7, 2001

(65) Prior Publication Data

US 2002/0189812 A1 Dec. 19, 2002

Related U.S. Application Data

(60) Provisional application No. 60/283,240, filed on Apr. 11, 2001.

(51) Int. Cl.[7] ..... E21B 29/12

(52) U.S. Cl. ..... 166/367; 166/350; 166/359; 114/264; 405/224.4

(58) Field of Search ..... 166/350, 345, 166/359, 362; 114/266, 265, 267, 243, 264; 405/145.1, 215, 219, 224, 224.1, 224.4, 204, 205

(56) References Cited

U.S. PATENT DOCUMENTS

| | | | | | |
|---|---|---|---|---|---|
| 2,669,960 | A | * | 2/1954 | Laycock | |
| 2,963,868 | A | * | 12/1960 | Armstrong | |
| 3,207,110 | A | * | 9/1965 | Laborde et al. | |
| 4,448,266 | A | * | 5/1984 | Potts | 166/367 |
| 4,740,109 | A | * | 4/1988 | Horton | 114/265 |
| 4,823,719 | A | * | 4/1989 | Sarwe | 114/126 |
| 4,869,192 | A | * | 9/1989 | Pawolski | 114/123 |
| 4,934,870 | A | * | 6/1990 | Petty et al. | 405/199 |
| 5,683,206 | A | * | 11/1997 | Copple | 166/367 |
| 5,823,131 | A | * | 10/1998 | Boatman et al. | 114/230.12 |
| 6,019,055 | A | * | 2/2000 | Likitcheva | 114/266 |
| 6,161,620 | A | * | 12/2000 | Cox et al. | 166/359 |
| 6,260,625 | B1 | * | 7/2001 | Phan et al. | 166/355 |
| 6,263,824 | B1 | * | 7/2001 | Balint et al. | 114/264 |
| 6,347,912 | B1 | * | 2/2002 | Thomas | 405/224.2 |
| 6,352,116 | B1 | * | 3/2002 | Borseth | 166/359 |
| 6,375,391 | B1 | * | 4/2002 | B.o slashed.rseth et al. | 114/264 |
| 6,402,431 | B1 | * | 6/2002 | Nish | 405/224.3 |

FOREIGN PATENT DOCUMENTS

JP 1-273783 * 11/1989

OTHER PUBLICATIONS

Huse, E., et al. *Impulse and Energy in Deepsea Riser Collisions Owing to Wake Interference*, OTC, 2000 Offshore Technology Conference.

* cited by examiner

*Primary Examiner*—Robert E. Pezzuto
*Assistant Examiner*—Thomas A. Beach
(74) *Attorney, Agent, or Firm*—Klein, O'Neill & Singh, LLP.

(57) ABSTRACT

A guide for a buoyancy can on a floating offshore platform. The platform includes at least one support structure adjacent the buoyancy can. The guide comprises at least one compression pad supported by the support structure and adjacent the exterior surface of the buoyancy can. Lateral movement of the buoyancy can toward the support structure compresses the compression pad so as to absorb the force generated by the buoyancy can movement, and so as to protect the buoyancy can and components of the floating offshore platform from damage.

51 Claims, 8 Drawing Sheets

COMPLIANT BUOYANCY CAN GUIDE

CROSS-REFERENCE TO RELATED APPLICATIONS

This application claims priority to U.S. Provisional Patent Application Serial No. 60/283,240, filed Apr. 11, 2001.

STATEMENT REGARDING FEDERALLY SPONSORED RESEARCH OR DEVELOPMENT

Not applicable.

BACKGROUND OF THE INVENTION

The present invention generally relates to floating offshore mineral exploration and production platforms and, more particularly, is concerned with a compliant guide for protecting the buoyancy cans and components of the floating offshore platform from damage from impacts which occur as a result of hydrodynamic loads (e.g. Froude—Krylov impact forces) on the buoyancy cans.

The spacing between the buoyancy can outer wall and the contact point of the guide structure in the centerwell of a Spar type floating offshore mineral exploration and production platform has been found to be very important in determining loads on the buoyancy can. The buoyancy can will have contact points (most typically four to six), in the form of built-up wear strips. These contact points on the buoyancy can will face corresponding contact points on the guide structure. See U.S. Pat. No. 4,702,321 to Edward Horton for "Drilling, Production, and Oil Storage Caisson for Deep Water" and U.S. Pat. No. 4,740,109 to Edward Horton for "Multiple Tendon Compliant Tower Construction", both incorporated herein by reference.

Although sensitivity to gap size had previously been noticed in both model tests and in some calculations, efforts to determine the optimum gap size had assumed that once a small enough gap had been achieved, the nature and magnitude of the loads, including impact loads, would converge to those of a zero gap. Efforts were aimed at finding the point of diminishing returns on an exponential-type either load or bending moment response curve, where forces were determined without consideration for impact loads.

BRIEF SUMMARY OF THE INVENTION

Previous attempts to minimize the gap have been dependent on the tolerances that are achievable in fabricating buoyancy cans, guides, and supporting structures. Recent analytical and model test work has indicated that the conclusions made previously did not fully account for impact loads, and that the nature of the signal is quite different if there is a gap that is large enough for these fabrication tolerances. Loads on the buoyancy can and guide have been found to be large and numerous enough to make practical design for both strength and fatigue difficult. Therefore, there is a need to reduce loads, particularly impact loads, on buoyancy cans.

It has been found that the solution to the above-described problem involves the insertion of an additional flexible element between the guide, the guide support structure, and the buoyancy can. One result of such an insertion is reduction of the effective gap size. In some embodiments of the invention, therefore, the gap will be, effectively, zero, (potentially with some preload). Thus, the insert provides for practical fabrication tolerances. Since the gap size is small, the relative velocity at impact is also small. If the gap is effectively zero, the loads are roughly equivalent to the loads calculated using the closed gap assumption. Additionally, if there were to be an impact load, the stiffness of the connection is reduced, in some embodiments, by designing the compliant guide stiffness to meet load requirements.+

Using a computer simulation program, loads on the guides were computed for a given random excitation for a number of gap sizes both with and without the compliant guide. Results for maximum load from these simulations are shown in FIG. 18. FIG. 18 clearly shows that the maximum loads for a given gap size are reduced tremendously by the insertion of the flexible element, as compared to the previous rigid, steel-to-steel contact designs. FIG. 18 also shows that there is a benefit associated with the use of a preload in some embodiments. However, in alternative embodiments, there is zero preload, since introduction of an unnecessarily high preload could potentially introduce other problems.

According to one example embodiment of the invention, a guide for a buoyancy can on a floating offshore platform is provided. The platform includes at least one support structure adjacent the buoyancy can. The guide comprises at least one compliant guide member supported by the support structure and adjacent the exterior surface of the buoyancy can. Lateral movement of the buoyancy can toward the support structure compresses the compliant member so as to absorb the force generated by the buoyancy can movement, and so as to protect the buoyancy can and components of the floating offshore platform from damage. A wear pad disposed between each guide structure and buoyancy can protects the guide and buoyancy can from friction wear.

According to another example embodiment of the invention, a guide for a buoyancy can on a floating offshore platform is provided. The platform includes at least one support structure adjacent the buoyancy can. The support structure has at least one projection attached thereto. The guide comprises at least one elastomeric compression pad supported by the support structure and adjacent the exterior surface of the buoyancy can. Lateral movement of the buoyancy can toward the support structure compresses the elastomeric compression pad so as to absorb the force generated by the buoyancy can movement, and so as to protect the buoyancy can and components of the floating offshore platform from damage. A wear pad disposed between each elastomeric compression pad and the buoyancy can protects the compression pad from friction wear against the buoyancy can. At least one carriage is attached to the guide. The carriage has a channel therein that slidingly engages the projection on the support structure.

According to still another example embodiment of the invention, a guide for a buoyancy can on a floating offshore platform is provided. The platform includes at least one support structure adjacent the buoyancy can. The support structure has upper and lower projections attached thereto. The guide comprises a plurality of elastomeric compression pads supported by the support structure and adjacent the exterior surface of the buoyancy can. Each compression pad has first and second opposite sides. Lateral movement of the buoyancy can toward the support structure compresses the elastomeric compression pads so as to absorb the force generated by the buoyancy can movement, and so as to protect the buoyancy can and components of the floating offshore platform from damage. A first rigid plate is associated with the first side of the compression pad. A second rigid plate is disposed between and affixed to the support structure and the second side of the compression pad for affixing the compression pad to the support structure. A wear pad support is attached to the first rigid plate. The wear pad support has upper and lower ends and comprises a base plate, a pair of spaced side plates attached to and extending from the base plate, and a top plate extending between the side plates. A wear pad is secured to the wear pad support. The wear pad is disposed between the compression pad and the buoyancy can for protecting the compression pad and buoyancy can from friction wear. Upper and lower carriages extend from the upper and lower ends, respectively, of the wear pad support. Each carriage has a channel therein that slidingly engages a respective projection on the support structure.

According to yet another example embodiment of the invention, a guide for a buoyancy can on a floating offshore platform is provided. The platform includes at least one support structure adjacent the buoyancy can. The support structure has upper and lower projections attached thereto. The guide comprises a plurality of elastomeric compression pads supported by the support structure and adjacent the exterior surface of the buoyancy can. Each compression pad has first and second opposite sides. Lateral movement of the buoyancy can toward the support structure compresses the elastomeric compression pads so as to absorb the force generated by the buoyancy can movement, and so as to protect the buoyancy can and components of the floating offshore platform from damage. A bearing plate is affixed to the first side of the compression pad. A first rigid plate is affixed to the bearing plate. A second rigid plate is disposed between and affixed to the support structure and the second side of the compression pad for affixing the compression pad to the support structure. A wear pad support is attached to the first rigid plate. The wear pad support has upper and lower ends. The wear pad support comprises a base plate, a pair of spaced side plates attached to and extending from the base plate, and a top plate extending between the side plates. A wear pad is secured to the wear pad support. It is disposed between the compression pad and the buoyancy can for protecting the compression pad and buoyancy can from friction wear. Upper and lower carriages extend from the upper and lower ends, respectively, of the wear pad support. Each carriage has a channel therein that slidingly engages a respective said projection on the support structure.

According to still another example embodiment of the invention, apparatus for compliantly guiding a buoyancy can on a floating offshore platform is provided. The apparatus comprises a plurality of spaced support structures attached to the platform and arranged radially around the exterior circumferential surface of the buoyancy can. At least one elastomeric compression pad is attached to each support structure and disposed adjacent the exterior surface of the buoyancy can. Lateral movement of the buoyancy can toward one of the support structures compresses the elastomeric compression pad attached thereto so as to absorb the force generated by the buoyancy can movement, and so as to protect the buoyancy can and components of the floating offshore platform from damage.

According to even a further example embodiment of the invention, for a floating offshore platform having at least one buoyancy can and a support structure adjacent the buoyancy can, a method is provided for protecting the buoyancy can and the support structure from damage caused by impact of the buoyancy can with the support structure. The method comprises supporting at least one compliant member between the buoyancy can and the support structure. The method further comprises absorbing the force generated by lateral movement of the buoyancy can by compressing the compliant member between the buoyancy can and the support structure.

According to still another example embodiment of the invention, for a floating offshore platform having at least one buoyancy can, a support structure for supporting a compliant guide for the buoyancy can is provided. The support structure comprises a T-girder and means for supporting the guide from the support structure.

BRIEF DESCRIPTION OF THE SEVERAL VIEWS OF THE DRAWINGS

For a more complete understanding of the present invention, and the advantages thereof, reference is now made to the following Detailed Description of the Invention taken in conjunction with the accompanying drawings, in which.

Figure A is a graph depicting maximum load reaction to both compliant (rubber) and non-compliant (steel) guides for random excitations of the buoyancy can over a range of buoyancy can-to-guide radial gap sizes.

DETAILED DESCRIPTION OF EXAMPLE EMBODIMENTS OF THE INVENTION

Figure 1:
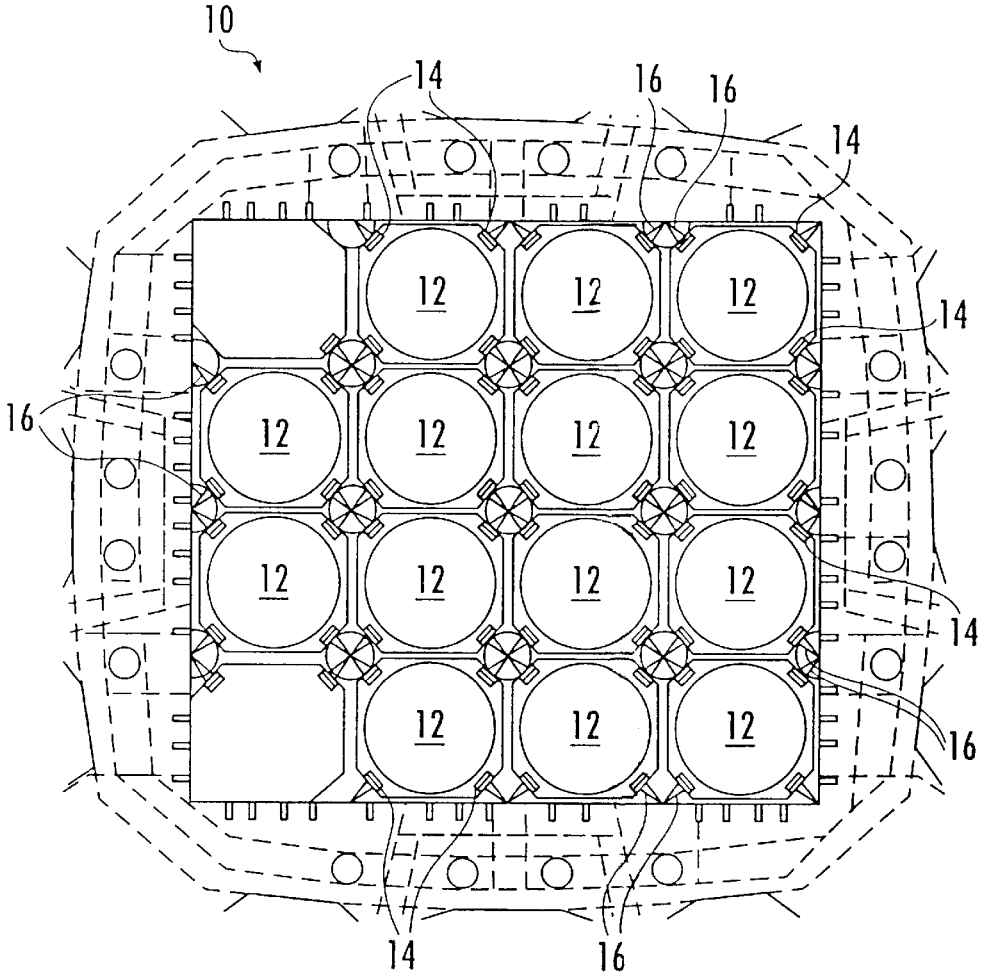
FIG. 1 is a cross-sectional, plan view of a Spar type floating offshore mineral exploration and production platform having compliant buoyancy can guides and support structures of the present invention.

In FIG. 1, there is shown, in cross-sectional plan view, a spar type floating offshore mineral exploration and production platform, generally designated 10. In this example, platform 10 includes a plurality of cylindrical buoyancy cans 12. A plurality of compliant guides 14 are spaced around the exterior circumferential surface of each buoyancy can 12. Although FIG. 1 shows four compliant guides 14 for each buoyancy can 12, it will be understood that more or fewer guides 14 may be used. The platform in the present example also includes a plurality of support structures 16 to which the compliant guides 14 are attached. Examples of buoyancy cans 12, compliant guides 14, and support structures 16 are more clearly seen in FIG. 2, and will be more fully described later.

Figure 3:
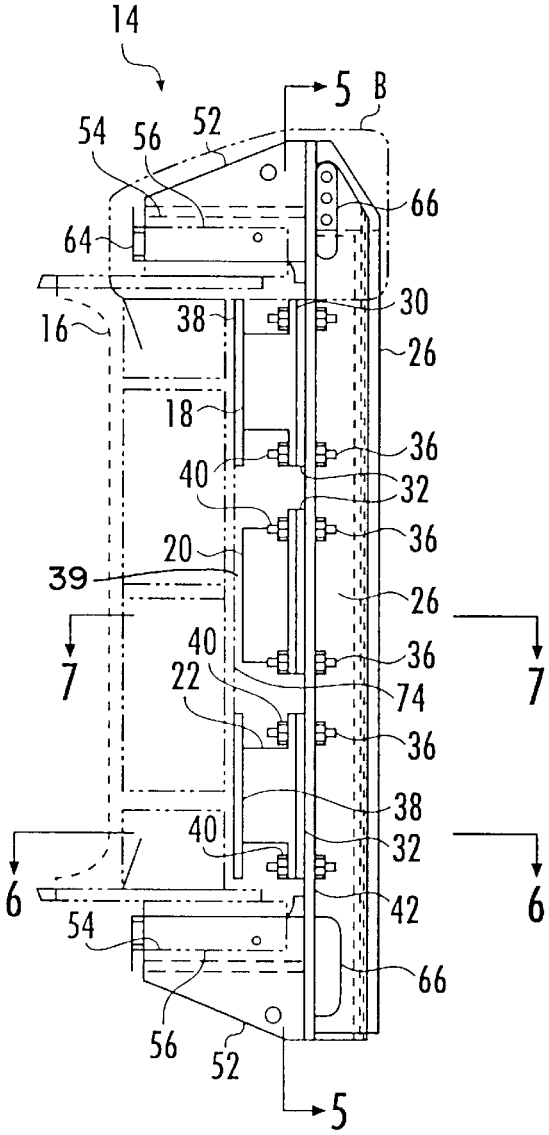
FIG. 3 is an elevation view of the compliant guide of the present invention taken along line 3—3 in FIG. 2.

Referring now to the example of FIG. 3, the illustrated example compliant guide 14 includes three vertically spaced elastomeric compression pads 18, 20, and 22. Lateral movement of buoyancy can 12 (not shown in FIG. 3) toward support structure 16 compresses the elastomeric compression pads 18, 20, and 22 so as to absorb the force generated by buoyancy can 12 movement. Buoyancy can 12 and components of the floating offshore platform 10 are thus protected from impact damage. In some embodiment, upper and lower compression pads 18 and 22 are relatively soft, and middle compression pad 20 is relatively stiff.

Figure 4:
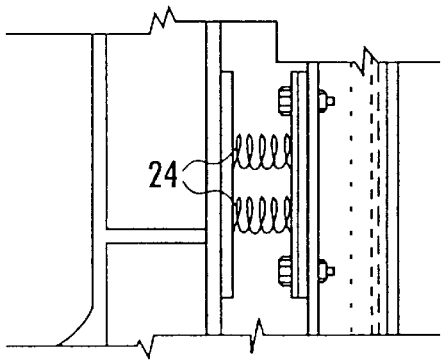
FIG. 4 is a partial elevation view taken along line 3—3 in FIG. 2, in which an elastomeric compression pad is replaced by helical compression springs.
Figure 17:
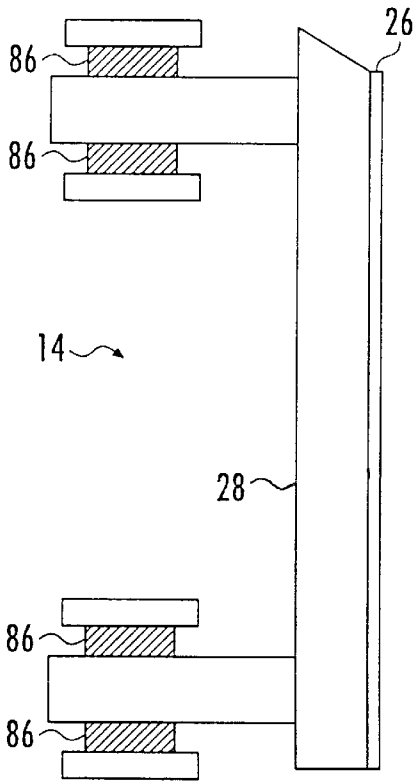
FIG. 17 is a partial elevation view taken along line 3—3 in FIG. 2, in which the elastomeric compression pads are replaced by elastomeric shear pads.
Figure 16:
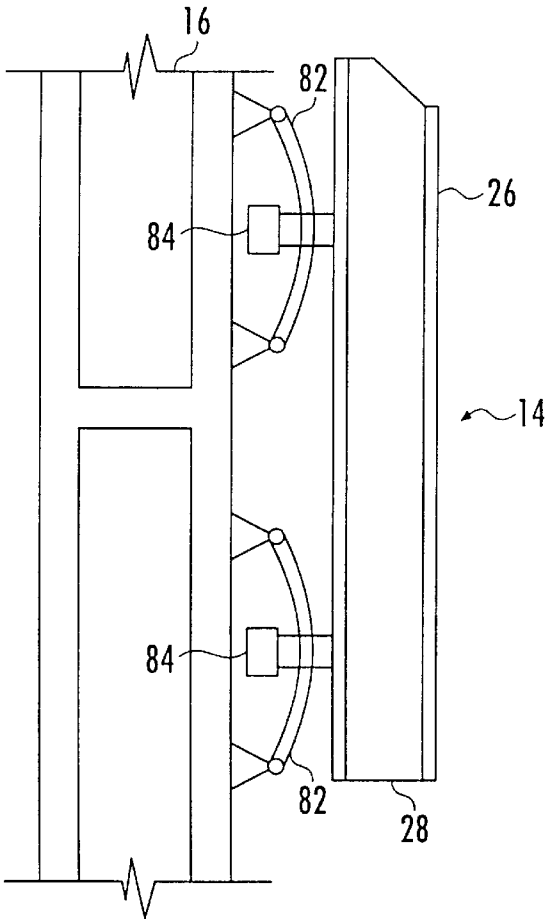
FIG. 16 is a partial elevation view taken along line 3—3 in FIG. 2, in which the elastomeric compression pads are replaced by leaf springs.
Figure 18:
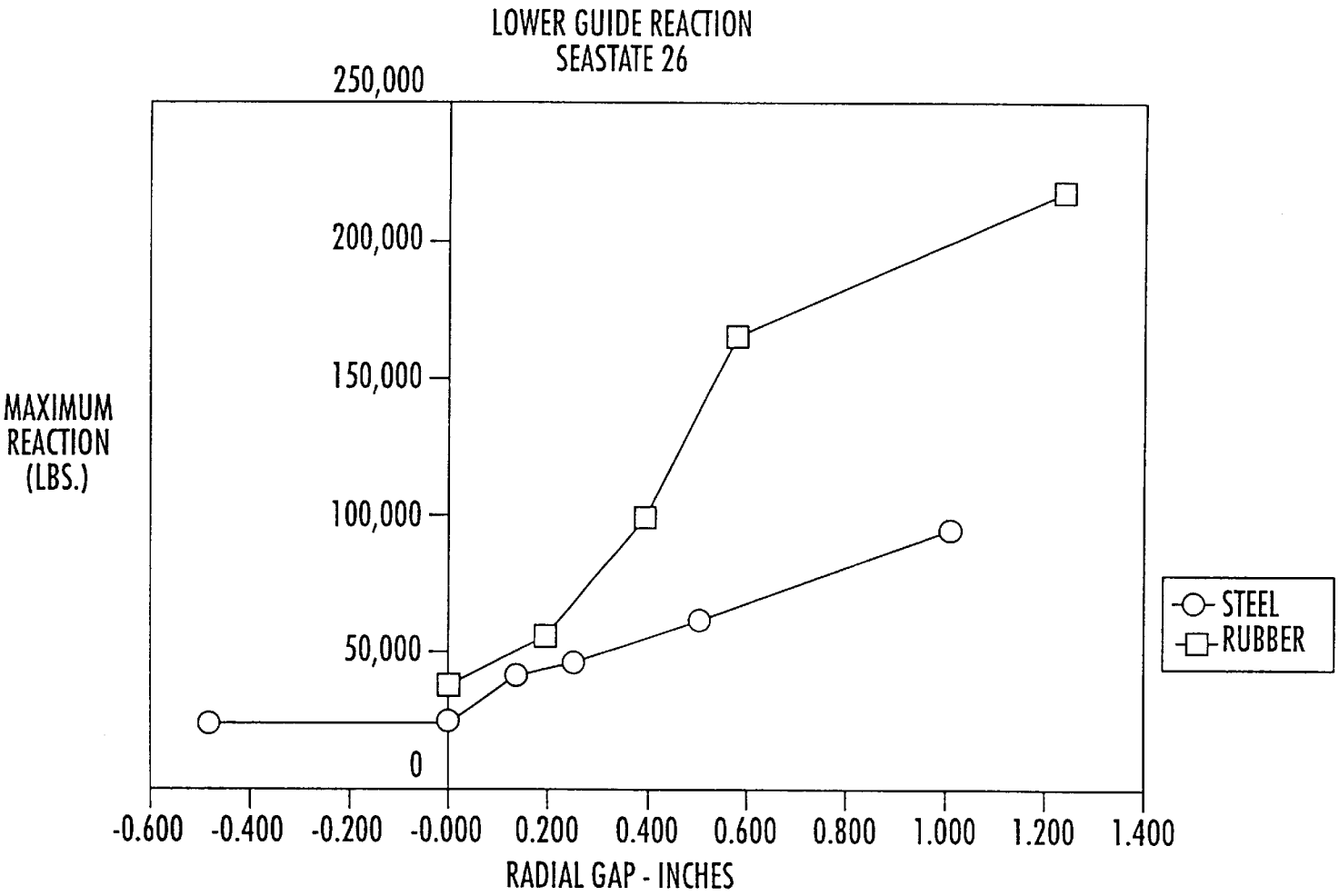
FIG. 18 is a graph depicting maximum load reaction to both compliant (rubber) and non-compliant (steel) guides for random excitations of the buoyancy can over a range of buoyancy can-to-guide radial gap sizes.

Other combinations of stiffness, or use of spring components, will occur to those of skill in the art. For example, a spring or other compliant member is used in alternate embodiments instead of elastomeric compression pads 18, 20, and 22 to absorb the force generated by movement of buoyancy can 12. FIG. 4 is a partial view of an example compliant guide 14 having a pair of helical compression springs 24 instead of an elastomeric compression pad. FIG. 16 is a partial view of a compliant guide 14 in which leaf springs 82 absorb the force generated by movement of buoyancy can 12. In this embodiment, stops 84 limit the extent of displacement of guide 14 toward support structure 16. In different embodiments, leaf springs 82 comprise steel or other suitable metallic material, e.g., titanium. FIG. 17 is a partial view of a compliant guide 14 in which elastomeric shear pads 86 absorb the force generated by movement of buoyancy can 12. On other embodiments, the force generated by movement of buoyancy can 12 is absorbed by pneumatic cylinders, hydraulic cylinders, an accumulator cylinder, or an air/elastomer device.

Figure 6:
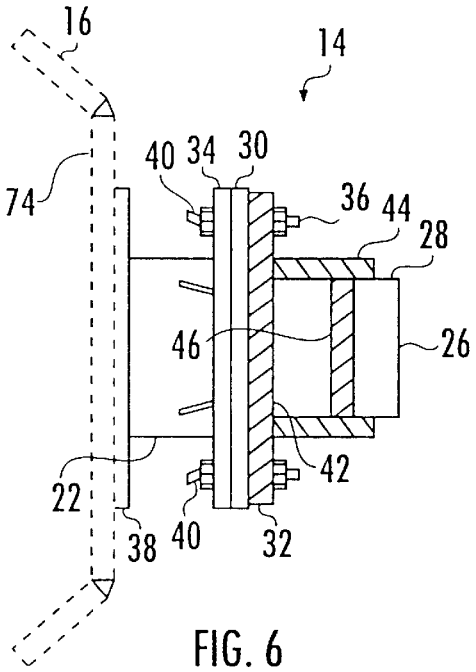
FIG. 6 is a cross-sectional view taken along line 6—6 in FIG. 3.
Figure 7:
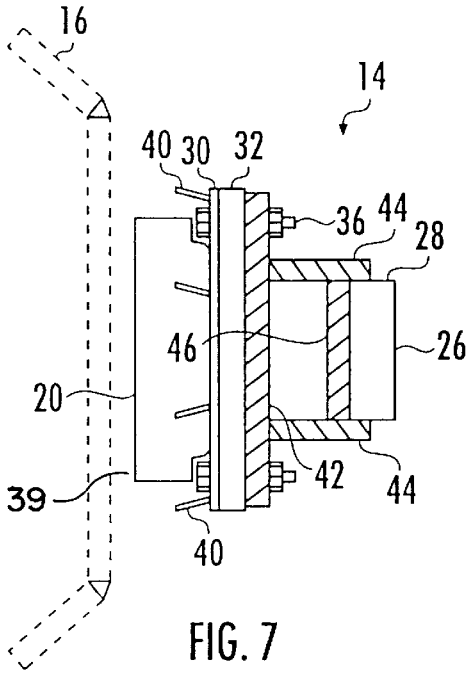
FIG. 7 is a cross-sectional view taken along line 7—7 in FIG. 3.

Referring next to FIGS. 6 and 7, compliant guide 14 in the illustrated embodiment, includes a wear pad 26 disposed between each compression pad 18, 20, and 22, and buoyancy can 12 (not shown in FIGS. 6 and 7) for minimizing the friction between compliant guide 14 and buoyancy can 12 and for protecting compression pads 18, 20, and 22 from friction wear against buoyancy can 12. In some embodiments, wear pad 26 comprises ULTRA HIGH MOLECULAR WEIGHT (UHMW) polyethylene. In other embodiments, wear pad 26 comprises steel or other ferrous or non-ferrous metal, nylon, Delryn, or other low friction material. In a more specific embodiment, wear pad 26 comprises steel of a different hardness than that of buoyancy can 12. Other suitable wear and/or friction reduction materials that may be used for wear pad 26 will occur to those of skill in the art. Wear pad support 28 secures wear pad 26 with respect to compression pads 18, 20, and 22.

In some embodiments, a bearing plate and pad retainer 30 is affixed to the first side of the of the compression pads 18, 20, and 22. A first rigid plate 32 is affixed to the side of the bearing plate 30 opposite the compression pads 18, 20, and 22. Wear pad support 28 is attached to the sides of the first rigid plates 32 opposite bearing plates 30. For upper and lower compression pads 18 and 22, junction plates 34 are affixed to bearing plates 30 near their outer edges. Wear pad support 28 is removable attached to first rigid plate 32, bearing plate 30, and junction plate 34 by bolts 36, by welding, or by other suitable mechanical fasteners. A second rigid plate 38 is disposed between, and affixed to, support structure 16 and the second side of the upper and lower compression pads 18 and 22 for fixing the upper and lower compression pads 18 and 22, to support structure 16, as shown in FIGS. 3 and 6, whereby a gap 39 is provided between the middle compression pad 20 and the support structure 16, as shown in FIGS. 3 and 7.

For each compression pad 18, 20, and 22, a retainer basket 40 extends out from bearing plate 30 adjacent to the sides of the compression pad for capturing and retaining the compression pad in the unlikely event that it becomes disbanded from its bearing plate 30. Retainer basket 40 also helps to distribute the bolting force equally around bearing plate 30. Equal force distribution helps to avoid damaging the elastomeric pad.

Figure 8:
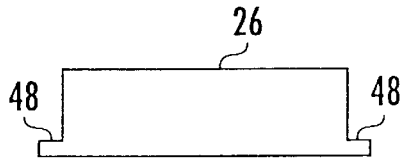
FIG. 8 is a cross-sectional view of the wear pad shown in FIGS. 6 and 7.
Figure 9:
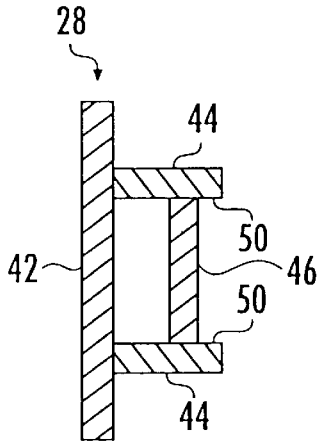
FIG. 9 is a cross-sectional view taken along line 9—9 in FIG. 3, in which the elastomeric compression pad is omitted for clarity.

In some embodiments, wear pad support 28 comprises a base plate 42, a pair of spaced side plates 44 attached to and extending from base plate 42, and a top plate 46 extending between side plates 44. In some example embodiments, top plate 46 and the outer edges of side plates 44 form a receptacle for securing wear pad 26 therein. Other suitable wear pad supports and structural components that may be used will occur to those of skill in the art. Referring to FIG. 8, longitudinal flanges 48 are formed in some embodiments on the opposite edges of wear pad 26. Referring to FIG. 9, side plates 44 of wear pad support 28 contain in some embodiments, corresponding longitudinal grooves 50 for receiving wear pad flanges 48 for retaining wear pad 26 on wear pad support 28.

Figure 5:
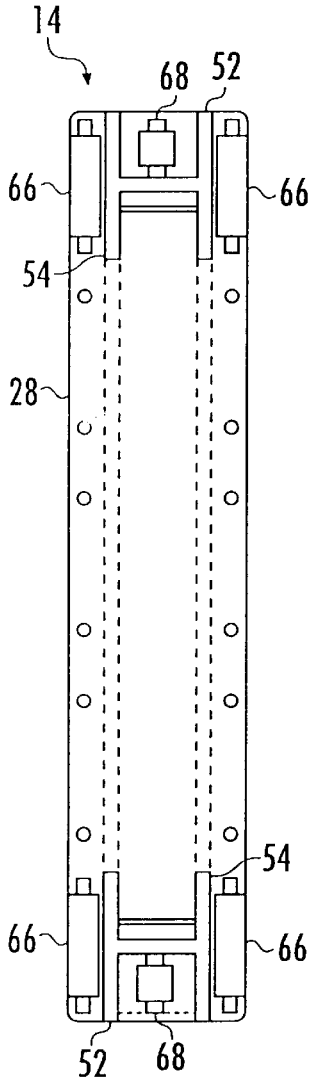
FIG. 5 is an elevation view taken along line 5—5 in FIG. 3, in which the elastomeric compression pads are omitted for clarity.
Figure 10:
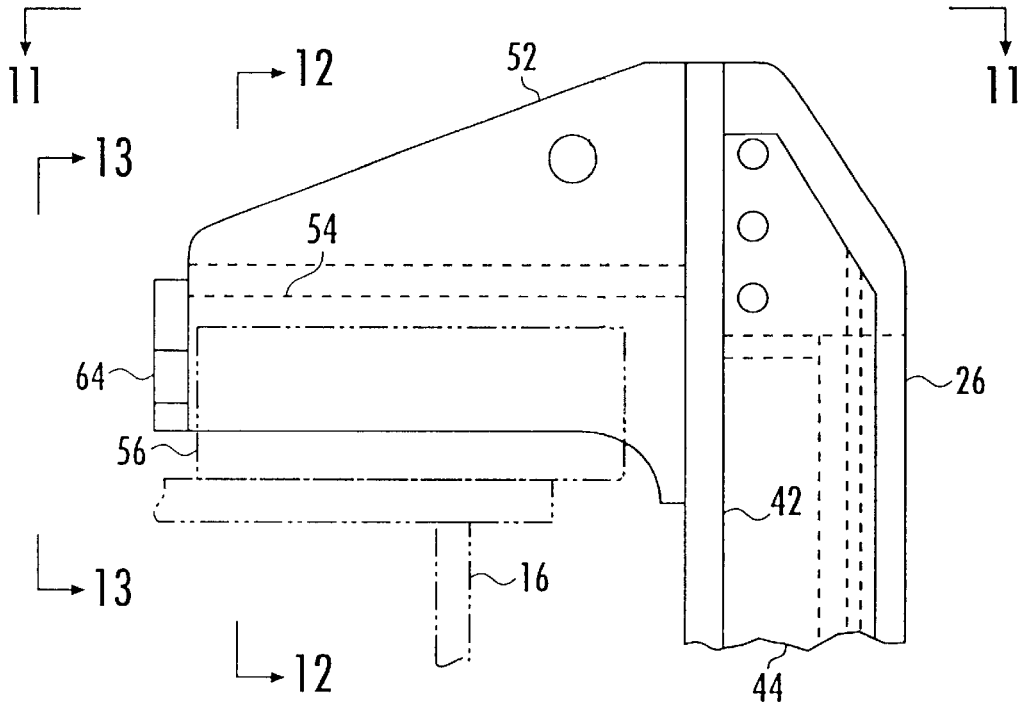
FIG. 10 is an enlarged, detail elevation view of the encircled portion of the compliant guide of FIG. 3 designated "B".
Figure 11:
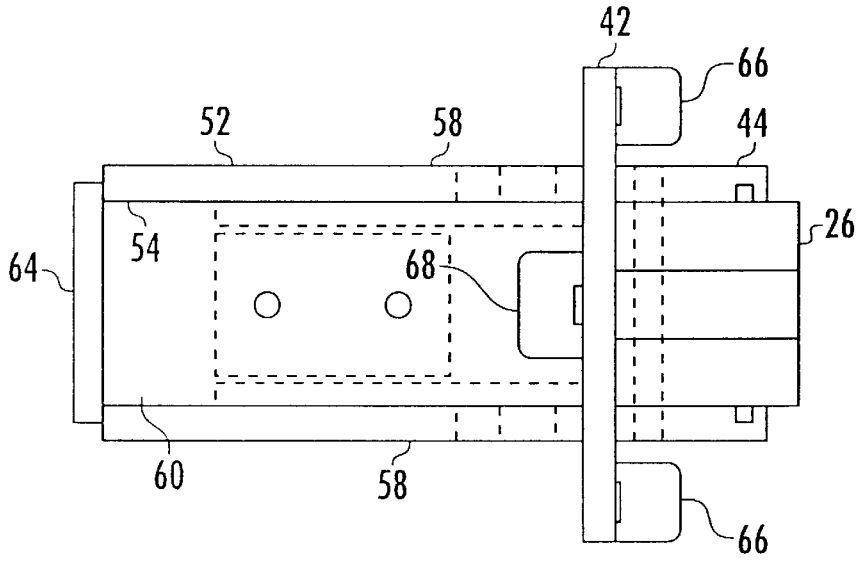
FIG. 11 is a cross-sectional view taken along line 11—11 in FIG. 10.

Referring to FIGS. 3 and 5, there is shown an example means for supporting compliant guide 14 from support structure 16. In this example, a carriage 52 extends laterally from each end of guide 14. Channel 54 in carriage 52 slidingly engages a corresponding projection 56 attached to support structure 16. FIGS. 10 and 11 illustrate a more detailed example embodiment of carriage 52 on the upper end of guide 14.

Figure 12:
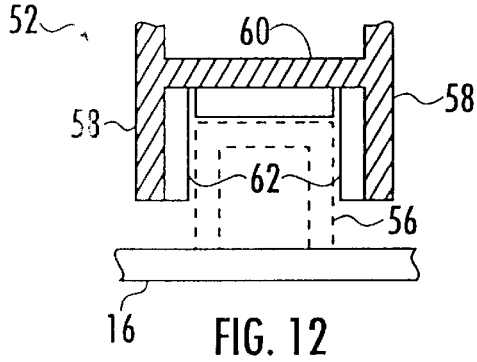
FIG. 12 is a cross-sectional view taken along line 12—12 in FIG. 10.

Referring to FIG. 12, carriage 52 comprises, in some embodiments, a pair of spaced side plates 58 fastened to a bottom plate 60. A wear pad 62 is affixed to each of side plates 58 and to bottom plate 60 of carriage 52 for protecting the surfaces of carriage 52 from friction wear against projection 56. Wear pads 62 comprise ULTRA HIGH MOLECULAR WEIGHT (UHMW) polyethylene or other suitable wear material that will occur to those of skill in the art.

Figure 13:
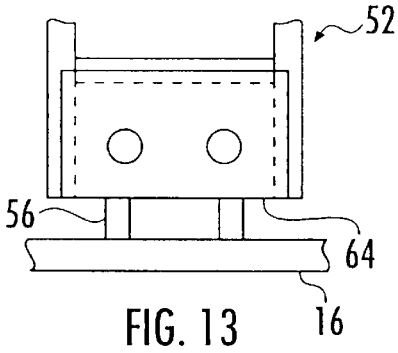
FIG. 13 is a cross-sectional view taken along line 13—13 in FIG. 10.

Referring now to FIG. 13, an example embodiment is seen in which an end plate 64 is fastened to the outer end of carriage 52 to retain projection 56 within channel 54 of carriage 52, and thus retain compliant guide 14 on support structure 16.

Referring to FIGS. 3, 5, and 11, a pair of anodes 66 are affixed to each end of wear pad support 28 for cathodic protection of the guide assembly from corrosion in seawater. An anode 68 is also affixed to each end of wear pad support 28 for cathodic protection of the guide assembly from corrosion in seawater.

In one embodiment, elastomeric compression pads 18, 20, and 22 comprise natural or synthetic rubber elastomeric compound. In other embodiments, compression pads 18, 20, and 22 are replaced by helical or leaf springs, air or liquid filled bumpers, or other passive or active systems that provide increased force with increased displacement. Bearing plates 30, first and second rigid plates 32 and 38, respectively, junction plates 34, base plates 42, side plates 44, top plates 46, side plates 58, bottom plates 60, and end plates 64 preferably comprise rigid steel plate.

Figure 2:
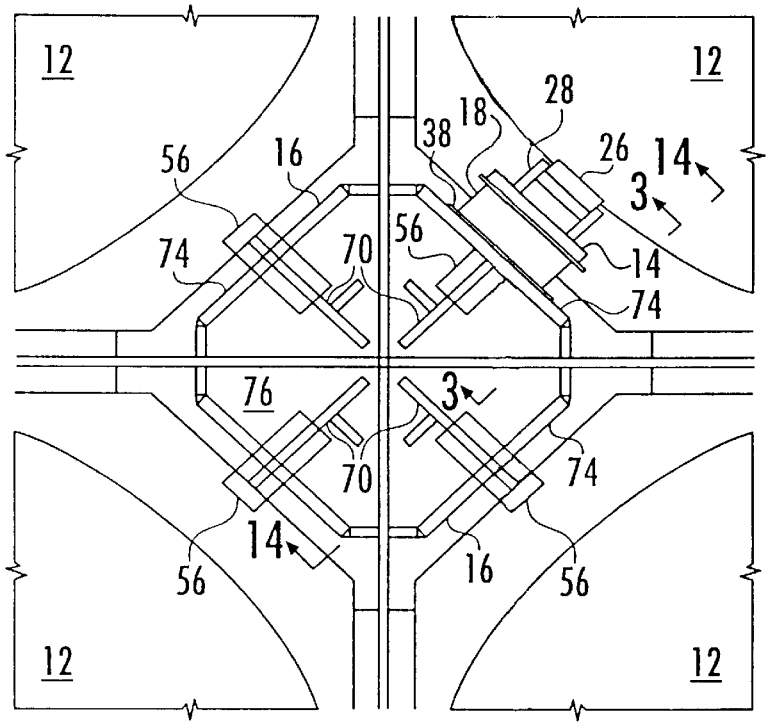
FIG. 2 is an enlarged, detail view of the encircled portion of the platform of FIG. 1 designated "A".
Figure 15:
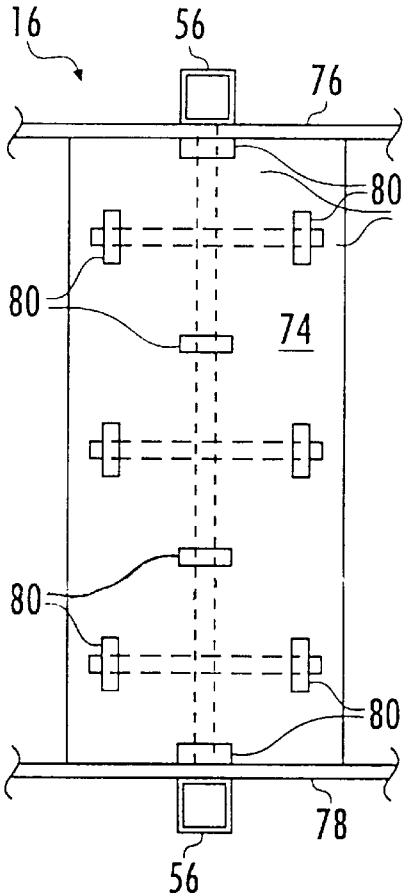
FIG. 15 is an elevation view taken along line 15—15 in FIG. 14.
Figure 14:
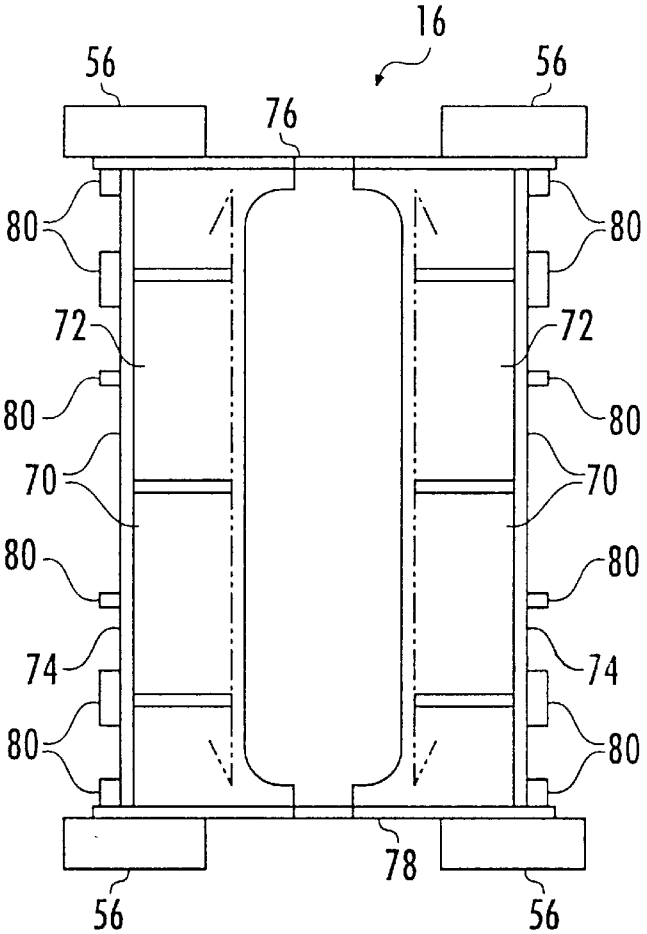
FIG. 14 is an elevation view of the support structure of the present invention taken along line 14—14 in FIG. 2.

FIGS. 2, 14 and 15 illustrate example support structures 16 for supporting compliant guide 14. Support structure 16 in some embodiments comprises T-girder 70, which is made up of web 72 and face plate 74. An upper plate 76 is secured to the upper end of T-girder 70, and a lower plate 78 is secured to the lower end of T-girder 70. Projection 56 attached to upper plate 76 slidingly engages upper carriage 52 of compliant guide 14 for supporting guide 14 from support structure 16. Projection 56 attached to lower plate 78 slidingly engages lower carriage 52 of compliant guide 14 for further supporting guide 14 from support structure 16. Projections 56 comprise, in some embodiments, square steel tubes welded to upper and lower plates 76 and 78. T-girder 70 and upper and lower plates 76 and 78, respectively, comprise steel in some embodiments.

As seen in FIGS. 2, 3, 6, and 15, second rigid plates 38 of compliant guides 14 are secured to face plate 74 of T-girder 70. As seen in FIGS. 14 and 15, a plurality of rigid steel bars 80 are attached to face plate 74 of T-girder 70 adjacent the edges of compression pads 18 and 22 (not shown in FIGS. 14 and 15) for assisting in retaining compression pads 18 and 22 in their positions on face plate 74. It will be understood that other types of compression pad retaining members known to those skilled in the art may be used instead of rigid steel bars 80.

The compliant buoyancy can guide of the present invention, and many of its intended advantages, will be understood from the foregoing description of example embodiments, and it will be apparent that, although various examples of the invention and their advantages have been described in detail, various changes, substitutions, and alterations will occur to those of skill in the art in the manner, procedure, and details thereof without departing from the spirit and scope of the invention, as defined by the appended claims, or sacrificing all of its material advantages.

We claim:

1. A guide for a buoyancy can on a floating offshore platform, the platform including at least one support structure adjacent the buoyancy can, the guide comprising:

at least one compliant member including a plurality of vertically-spaced, elastomeric compression pads supported by the support structure adjacent the exterior surface of the buoyancy can;

wherein at least one of the compression pads is relatively soft, and at least one of the compression pads is relatively stiff.

2. The guide of claim 1, further including a wear pad disposed between the compression pads and the buoyancy can for protecting the compression pads from friction wear against the buoyancy can.

3. The guide of claim 2, wherein the wear pad comprises ULTRA HIGH MOLECULAR WEIGHT (UHMW) polyethylene.

4. The guide of claim 2, further including a wear pad support for securing the wear pad with respect to the compression pads.

5. The guide of claim 4, wherein each compression pad has first and second opposite sides, and further including:

a bearing plate affixed to the first side of the compression pad; and a first rigid plate affixed to the bearing plate, wherein the wear pad support is attached to the first rigid plate.

6. The guide of claim 5, further including at least one junction plate affixed to the bearing plate near an edge of the bearing plate.

7. The guide of claim 6, wherein the wear pad support is removably attached to at least one of the first rigid plate, the bearing plate, and the junction plate by at least one mechanical fastener.

8. The guide of claim 5, further including a retainer basket extending from the bearing plate and disposed adjacent to the sides of the compression pad for retaining the compression pad if it detaches from the bearing plate.

9. The guide of claim 5, further including a second rigid plate disposed between and affixed to the support structure and the second side of the compression pad for affixing the compression pad to the support structure.

10. The guide of claim 4, wherein the wear pad support comprises:

a base plate;

a pair of spaced side plates attached to and extending from the base plate; and a top plate extending between the side plates, the top plate and the outer edges of the side plates forming a receptacle for securing the wear pad therein.

11. The guide of claim 10, wherein:

the wear pad has opposite edges, each opposite edge having a longitudinal flange thereon, and the side plates of the wear pad support have corresponding longitudinal grooves therein for receiving the wear pad flanges for retaining the wear pad on the wear pad support.

12. The guide of claim 4, wherein the guide includes means for supporting the guide from the support structure.

13. The guide of claim 12, wherein the means for supporting the guide from the support structure comprises at least one member of the guide that slidingly engages a corresponding member of the support structure.

14. The guide of claim 13, wherein at least one carriage attached to the guide has a channel therein that slidingly engages a corresponding projection attached to the support structure.

15. The guide of claim 14, wherein the wear pad support has opposite ends, and wherein the means for supporting the guide from the support structure includes two of said carriages, one of said carriages extending laterally from each of the ends of the wear pad support.

16. The guide of claim 14, further including at least one wear pad disposed within the channel of the carriage for slidingly engaging the corresponding projection on the support structure to reduce friction between the projection and the carriage and to prevent binding.

17. The guide of claim 16, wherein the carriage comprises a pair of spaced side plates fastened to a bottom plate, and wherein one of said wear pads is affixed to each of the side plates and to the bottom plate of the carriage.

18. The guide of claim 15, further including at least one anode affixed to at least one end of the wear pad support for cathodic protection of the guide from corrosion in sea water.

19. The guide of claim 1, wherein the plurality of compression pads includes an upper compression pad, a lower compression pad, and a middle compression pad located between the upper and lower compression pads.

20. The guide of claim 19, wherein the upper and lower compression pads are made of a relatively soft elastomer, and wherein the middle compression pad is made of a relatively stiff elastomer.

21. The guide of claim 20, wherein the upper, lower, and middle compression pads are attached to a pad support that is supported by the support structure, and wherein the middle pad is spaced from the support structure by a gap.

22. A guide for a buoyancy can on a floating offshore platform, the platform including at least one support structure adjacent the buoyancy can, the support structure having at least one projection attached thereto, the guide comprising:

at least one elastomeric compression pad supported by the support structure and adjacent the exterior surface of the buoyancy can, a wear pad disposed between each elastomeric compression pad and the buoyancy can; and at least one carriage attached to the guide, the carriage having a channel therein that slidingly engages said projection on the support structure.

23. The guide of claim 22, wherein the wear pad comprises ULTRA HIGH MOLECULAR WEIGHT (UHMW) polyethylene.

24. The guide of claim 22, further including a wear pad support for securing the wear pad to the guide.

25. The guide of claim 24, wherein the elastomeric compression pad has first and second opposite sides, and further including:

a bearing plate affixed to the first side of the compression pad; and a first rigid plate affixed to the bearing plate, wherein the wear pad support is attached to the first rigid plate.

26. The guide of claim 25, further including at least one junction plate affixed to the bearing plate near an edge of the bearing plate.

27. The guide of claim 25, wherein the wear pad support is removably attached to at least one of the first rigid plate, the bearing plate, and the junction plate by at least one mechanical fastener.

28. The guide of claim 25, further including a retainer basket extending from the bearing plate and disposed adjacent to the sides of the compression pad for retaining the compression pad if it detaches from the bearing plate.

29. The guide of claim 25, further including a second rigid plate disposed between and affixed to the support structure and the second side of the elastomeric compression pad for affixing the elastomeric compression pad to the support structure.

30. The guide of claim 24, wherein the wear pad support comprises:

a base plate;

a pair of spaced side plates attached to and extending from the base plate; and a top plate extending between the side plates, the top plate and the outer edges of the side plates forming a receptacle for securing the wear pad therein.

31. The guide of claim 30, wherein:

the wear pad has opposite edges, each opposite edge having a longitudinal flange thereon, and the side plates of the wear pad support have corresponding longitudinal grooves therein for receiving the wear pad flanges for retaining the wear pad on the wear pad support.

32. The guide of claim 24, wherein the wear pad support has opposite ends, and further including at least one anode affixed to at least one end of the wear pad support for cathodic protection of the guide from corrosion in sea water.

33. The guide of claim 22, further including at least one wear pad disposed within the channel of the carriage for slidingly engaging said projection on the support structure for protecting the carriage surfaces from friction wear against said projection.

34. The guide of claim 33, wherein the carriage comprises a pair of spaced side plates fastened to a bottom plate, and wherein one of said wear pads is affixed to each of the side plates and to the bottom plate of the carriage.

35. The guide of claim 22, wherein the guide includes three vertically spaced elastomeric compression pads supported by the support structure and adjacent the exterior surface of the buoyancy can, wherein the upper and lower compression pads are relatively soft, and wherein the middle compression pad is relatively stiff.

36. A guide for a buoyancy can on a floating offshore platform, the platform including at least one support structure adjacent the buoyancy can, the support structure having upper and lower projections attached thereto, the guide comprising:

a plurality of elastomeric compression pads supported by the support structure and adjacent the exterior surface of the buoyancy can, each compression pad having first and second opposite sides;

a first rigid plate associated with the first side of the compression pad;

a second rigid plate disposed between and affixed to the support structure and the second side of the compression pad for affixing the compression pad to the support structure;

a wear pad support attached to the first rigid plate, the wear pad support having upper and lower ends and comprising:

a base plate;

a pair of spaced side plates attached to and extending from the base plate; and a top plate extending between the side plates;

a wear pad secured to the wear pad support and disposed between the compression pad and the buoyancy can for protecting the compression pad from friction wear against the buoyancy can; and upper and lower carriages extending from the upper and lower ends, respectively, of the wear pad support, each carriage having a channel therein that slidingly engages a selected one of said projections on the support structure.

37. The guide of claim 36, wherein the wear pad comprises ULTRA HIGH MOLECULAR WEIGHT (UHMW) polyethylene.

38. The guide of claim 36, wherein:

the wear pad has opposite edges, each opposite edge having a longitudinal flange thereon, and the side plates of the wear pad support have corresponding longitudinal grooves therein for receiving the wear pad flanges for retaining the wear pad on the wear pad support.

39. The guide of claim 36, further including at least one wear pad disposed within the channel of the carriage for slidingly engaging the corresponding projection of the support structure for protecting the carriage surfaces from friction wear against the projection.

40. A guide for a buoyancy can on a floating offshore platform, the platform including at least one support structure adjacent the buoyancy can, the support structure having upper and lower projections attached thereto, the guide comprising:

a plurality of elastomeric compression pads supported by the support structure and adjacent the exterior surface of the buoyancy can, each compression pad having first and second opposite sides;

a bearing plate affixed to the first side of the compression pad;

a first rigid plate affixed to the bearing plate;

a second rigid plate disposed between and affixed to the support structure and the second side of the compression pad for affixing the compression pad to the support structure;

a wear pad support attached to the first rigid plate, the wear pad support having upper and lower ends and comprising:

a base plate;

a pair of spaced side plates attached to and extending from the base plate; and a top plate extending between the side plates;

a wear pad secured to the wear pad support and disposed between the compression pad and the buoyancy can for protecting the compression pad from friction wear against the buoyancy can; and upper and lower carriages extending from the upper and lower ends, respectively, of the wear pad support, each carriage having a channel therein that slidingly engages a respective one of said projections on the support structure.

41. The guide of claim 40, further including at least one junction plate affixed to the bearing plate near an edge of the bearing plate.

42. For a floating platform having at least one buoyancy can, a support structure for supporting a compliant guide for the buoyancy can, which comprises:

a T-girder; and means for supporting the guide from the support structure.

43. The support structure of claim 42, wherein the means for supporting the guide from the support structure comprises at least one member of the support structure that slidingly engages a corresponding member of the guide.

44. The support structure of claim 43, wherein the compliant guide includes at least one carriage having a channel therein, and wherein a corresponding projection attached to the support structure slidingly engages the channel in each carriage.

45. The support structure of claim 44, wherein the T-girder has upper and lower ends and the compliant guide includes upper and lower carriages, and further including:

an upper plate secured to the upper end of the T-girder, said projection corresponding to the upper carriage being attached to the upper plate; and a lower plate secured to the lower end of the T-girder, said projection corresponding to the lower carriage being attached to the lower plate of the T-girder.

46. The support structure of claim 45, wherein the corresponding projections attached to the upper and lower plates comprise square tubes secured to the upper and lower plates.

47. The support structure of claim 42, wherein the T-girder has a face plate, wherein the compliant guide includes at least one elastomeric compression pad, and wherein the elastomeric compression pad engages the face plate of the T-girder.

48. The support structure of claim 47, wherein a rigid plate is affixed to said at least one elastomeric compression pad, and wherein the rigid plate is secured to the face plate of the T-girder.

49. The support structure of claim 48, further including at least one compression pad retaining member attached to the face plate of the T-girder and adjacent the compression pad.

50. The support structure of claim 49, wherein the compression pad retaining member comprises rigid steel bar.

51. A guide for a buoyancy can on a floating offshore platform including a support structure, the guide comprising:

a wear pad support having a first surface facing a first surface of the support structure and a second surface adjacent the exterior surface of the buoyancy can;

upper and lower compliant members attached to the first surface of the wear pad support and to the first surface of the support structure; and a middle compliant member attached to the first surface of the wear pad support between the upper and lower compliant members and spaced from the support structure by a gap;

wherein the upper and lower compliant members are relatively soft, and wherein the middle compliant member is relatively stiff.

* * * * *

UNITED STATES PATENT AND TRADEMARK OFFICE

CERTIFICATE OF CORRECTION

PATENT NO. : 6,679,331 B2 
DATED : January 20, 2004
INVENTOR(S) : Alan R. Cordy et al.

It is certified that error appears in the above-identified patent and that said Letters Patent is hereby corrected as shown below:

Column 4,
Line 12, should be deleted: "Figure A is a graph depicting maximum load reaction to both compliant (rubber) and non-compliant (steel) guides for random excitations of the buoyancy can over a range of buoyancy can-to-guide radial gap sizes."

Column 9,
Line 1, "The guide of claim 20" should read as -- The guide of claim 19 --.

Signed and Sealed this

Sixteenth Day of March, 2004

JON W. DUDAS
*Acting Director of the United States Patent and Trademark Office*